US005713480A

United States Patent [19]

Petre et al.

[11] Patent Number: 5,713,480

[45] Date of Patent: Feb. 3, 1998

[54] MOLDED PLASTICS BOTTLE AND A MOLD FOR MAKING IT

[75] Inventors: Jean-Marie Petre, Bons-En-Chablais; Alain Colloud, Reyvroz, both of France

[73] Assignee: Societe Anonyme Des Eaux Minerales D'Evian, Evian-Les-Bains, France

[21] Appl. No.: 696,968

[22] PCT Filed: Mar. 13, 1995

[86] PCT No.: PCT/FR95/00291

§ 371 Date: Aug. 28, 1996

§ 102(e) Date: Aug. 28, 1996

[87] PCT Pub. No.: WO95/25041

PCT Pub. Date: Sep. 21, 1995

[30] Foreign Application Priority Data

Mar. 16, 1994 [FR] France ..... 94/03045

[51] Int. Cl.[6] ..... B65D 1/02

[52] U.S. Cl. ..... 215/373; 425/525

[58] Field of Search ..... 215/373, 374, 215/375; 264/523, 532, 537; 425/525

[56] References Cited

U.S. PATENT DOCUMENTS

| | | | |
|---|---|---|---|
| 4,850,493 | 7/1989 | Howard, Jr. | 215/375 |
| 4,978,015 | 12/1990 | Walker | 215/375 |
| 5,198,248 | 3/1993 | Krishnakumar et al. | 425/525 X |
| 5,287,978 | 2/1994 | Young et al. | 215/375 |
| 5,353,954 | 10/1994 | Steward et al. | 215/375 X |

FOREIGN PATENT DOCUMENTS

| | | |
|---|---|---|
| 348028 | 12/1989 | European Pat. Off. . |
| 2300707 | 9/1976 | France . |
| 2219077 | 3/1979 | France . |
| 2446228 | 8/1980 | France . |
| 2034663 | 6/1980 | United Kingdom . |
| WO 93/24377 | 12/1993 | WIPO . |

*Primary Examiner*—Christopher J. McDonald

*Attorney, Agent, or Firm*—Bell Seltzer Intellectual Property Law Group of Alston & Bird LLP

[57] ABSTRACT

A molded plastics bottle including a bottom having improved strength and stability, the bottom comprising a concave central portion (26) which connects via a plane annular surface (28) with a convex peripheral surface (30) for standing on a support surface (32), radial grooves (38) being formed in said convex annular surface (30) and connecting tangentially with the plane annular surface (28).

15 Claims, 4 Drawing Sheets

MOLDED PLASTICS BOTTLE AND A MOLD FOR MAKING IT

BACKGROUND OF THE INVENTION

The invention relates to a molded plastics bottle, designed in particular to contain still or non-aerated water, or some other non-aerated liquid. It also relates to a mold for making said bottle.

Bottles of this type are made of a plastics material such as, for example, PET (polyethylene terephthalate), PVC (polyvinyl chloride) or other material, by using well known injection blow-molding or extrusion blow-molding techniques. The bottles generally include a neck, designed to receive a closure cap, a cylindrical wall having transverse fluting, and a bottom having a shape designed to impart a certain amount of strength thereto.

It is known in particular to form a rounded indented central portion in the bottom of a bottle of this type, which portion connects with the cylindrical side wall of the bottle via a convex annular surface for standing on the ground which includes radial stiffening grooves or ribs (as described for example in French patents 2 219 077 and 2 300 707).

However, such bottoms always constitute the weak point of the bottles. In particular, vertical drop tests of full bottles demonstrate that the breakage or rupture rate of the bottom is about 70% for a bottle made of PVC falling on its bottom from a height of one meter.

Another drawback of such known bottoms is their low resistance to raised internal pressure, as can result from an increase in the storage temperature of full bottles and/or from shrinkage of the plastics material of the bottles during the two or three weeks following their manufacture and filling. The raised internal pressure in a hermetically sealed bottle results in the bottom becoming deformed and in the bottle becoming unstable.

Furthermore, at present, bottles of this type are packaged and transported in stacked and palletized loads, such that the bottoms of the bottles of the upper layers of a load rest on the tops of the bottles of the lower layers and are subjected by the lower layers to denting and puncturing stresses, which can lead to the bottoms rupturing or becoming permanently deformed, to bottles tilting in the load, and to the palletized loads becoming unstable.

A particular object of the invention is to avoid or at least reduce these drawbacks.

The invention provides a molded plastics bottle having a bottom which presents improved stability and improved resistance to denting.

To this end, the invention proposes a molded plastics bottle, comprising a neck designed to receive a top, a substantially cylindrical side wall and a bottom formed with a concave or indented central portion and a convex peripheral surface which includes radial grooves and which connects with the concave central portion of the bottom via a substantially plane annular surface, the bottle being characterized in that the bottom of each radial groove connects substantially tangentially with said plane annular surface.

In the present description, the curvature of a surface is always defined from the inside to the outside of the bottle, a concave surface thus having its concave face facing towards the outside of the bottle, a convex surface having its convex face facing towards the outside of the bottle.

It has been observed, in surprising manner, that a bottle bottom presenting the above-defined configuration has both stability and resistance to increased internal pressure and to puncturing stresses that are considerably greater than can be obtained in the prior art.

It is particularly because the grooves connect tangentially with the plane surface of the bottom that it is possible to prevent or considerably reduce deformation of the bottom under the effect of pressure variations inside the bottle, thereby guaranteeing its stability.

Advantageously, the radial width of said plane annular surface is greater than the radius of the concave central portion of the bottom of the bottle, and the diameter of said concave central portion of the bottom is less than the diameter of the top which is provided on the neck of the bottle.

In a preferred embodiment of the invention, the convex peripheral surface of the bottom connects with the plane annular surface via a concave annular surface, and with the side wall of the bottle via a convex cylindrical surface whose generator line is a circular arc having a large radius of curvature.

At one end, the bottom of each radial groove formed in the convex peripheral surface connects tangentially with the connecting surface between said plane annular surface and said convex peripheral surface.

At its other end, the bottom of each radial groove connects with the wall of the bottle via a concave surface.

In general, said shape for the bottom of a molded plastics bottle enables its resistance to denting and to increased internal pressure to be improved by a factor of 1.5 to 2, and the invention is applicable to bottles having bottoms that are circular or of some other shape, e.g. substantially square or rectangular, polygonal or other.

The invention also provides a mold for making a bottle of the type described above, said mold comprising a bottom wall formed with a convex or projecting central surface, a concave peripheral surface including radial ribs and a substantially plane annular surface connecting the central surface with the concave peripheral surface, the mold being characterized in that the tops of the radial ribs connect substantially tangentially with said plane annular surface.

The radial width of the plane annular surface of the bottom of the mold is preferably greater than the radius of the projecting central surface of the bottom of the mold.

The characteristics of the bottom of the bottle are generally found on the bottom of the mold with curvatures inverted in shape.

BRIEF DESCRIPTION OF THE DRAWINGS

The invention will be better understood and other characteristics, details and advantages thereof will appear more clearly on reading the following description, given by way of example and with reference to the accompanying drawings, in which.

DETAILED DESCRIPTION

Figure 1:
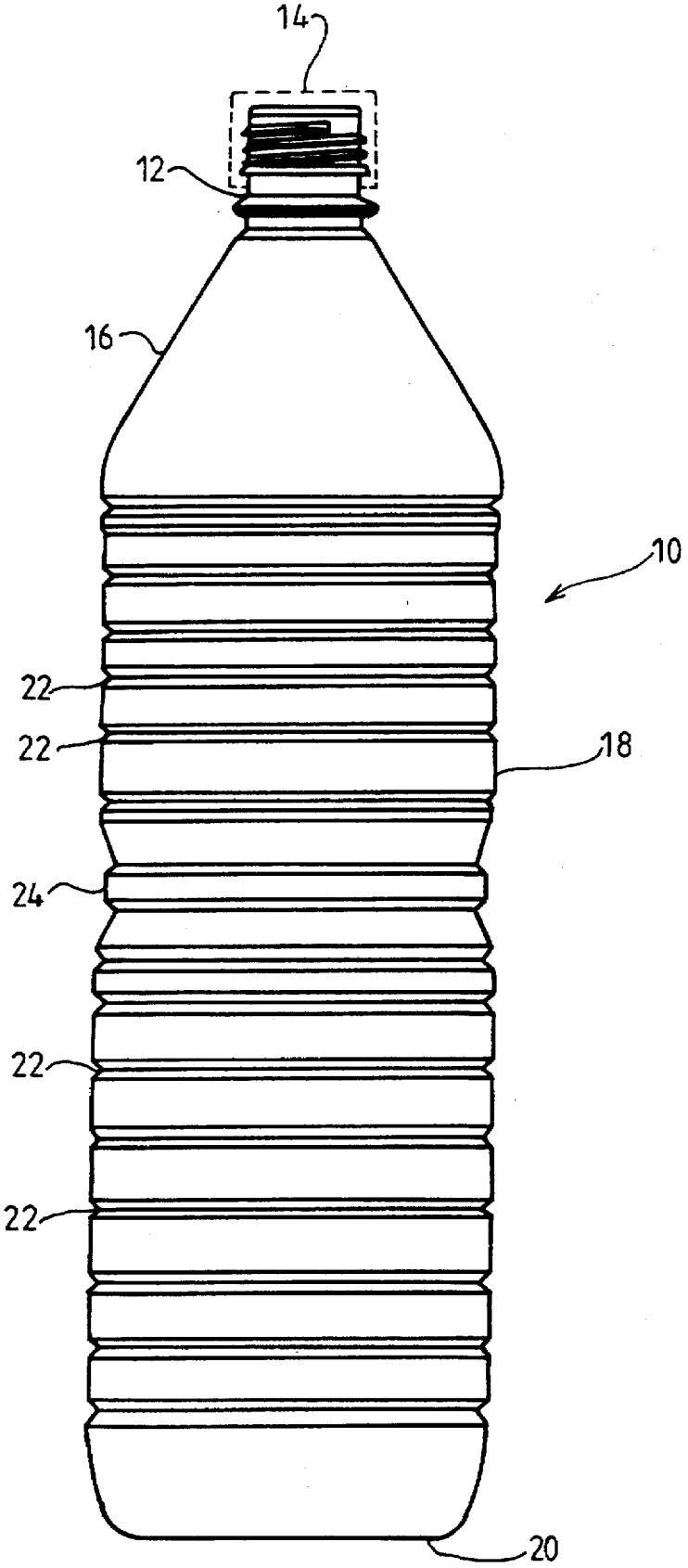
FIG. 1 is a diagrammatic elevation view of a bottle, made of plastics material, to which the invention is applicable.

The bottle 10 of FIG. 1, designed to contain still or non-aerated mineral water is of conventional shape and is made of a conventional material such as PET (polyethylene terephthalate) by injection blow-molding or by extrusion blow-molding.

The bottle essentially comprises a threaded neck 12 designed to receive a sealing screw-top 14, a tapered upper portion 16 connecting the neck 12 to a cylindrical side wall 18 of circular cross-section, and a bottom 20, the cylindrical side wall 18 of the bottle being formed with transverse stiffening fluting 22 and with a waist for grasping 24 provided substantially at mid-height.

The bottom 20 of the bottle (FIG. 2) has a circular outline and comprises a concave-shaped indented central portion 26 (its concave face facing towards the outside of the bottle, as indicated above) which connects with the side wall 18 of the bottle successively via a plane annular surface 28 and via a convex peripheral surface 30 which forms a bearing surface for the bottle to stand on any support 32, the bottom of the bottle further comprising a concave annular connecting surface 34 between the plane annular surface 28 and the convex peripheral surface 30, and a convex cylindrical connecting surface 36 between said convex peripheral surface 30 and the cylindrical wall 18 of the bottle.

Radial grooves 38 are formed in said convex peripheral surface 30, said grooves (which are grooves on the outside of the bottle and which form projecting ribs on the inside of the bottle) being regularly spaced-apart around the periphery of the convex surface 30, their number lying in the range 6 to 20, and preferably being 9, 10 or 11.

More precisely, the profile of the bottom of the bottle in axial section can be defined as follows, with reference to FIG. 2:

The convex cylindrical surface 36, which connects the straight cylindrical wall 18 of the bottle with the convex surface 30 for standing on the support, has a circularly arcuate generator line with a radius of curvature R1 which is relatively large, e.g. about 90 mm when the radius of the cross-section of the cylindrical wall 18 is about 45 mm.

The profile of the convex surface 30 is a circular arc of radius R2, e.g. about 7 mm in the above-mentioned example, which connects tangentially with the circular arc of radius R1 defining the surface 36.

The circular arc of radius R2 defining the profile of the convex surface 30 connects tangentially with the circular arc of radius R3 defining the profile of the concave annular surface 34, said radius R3 being about 20 mm in the above-mentioned example.

The circular arc of radius R3 defining the profile of the surface 34 connects tangentially with the plane annular surface 28 which extends perpendicularly to the longitudinal axis 40 of the bottle, the distance d between said plane annular surface 28 and the transverse plane tangential to the convex surface 30, being about 3 mm to 4 mm in the above-mentioned example.

The concave central portion 26 of the bottom is defined in axial section by a circular arc of radius R4 which is about 9 mm in the above-mentioned example, said concave circular arc of radius R4 connecting with the plane annular surface 28 via a convex annular surface 42 having a profile in axial section which is defined by a circular arc of radius R5 having a value of about 5 mm in the same example as above.

Each radial groove 38 has a V-shaped cross-section (FIG. 3) with a rounded bottom 44, the side walls 46 of each groove making between them an angle of about 70° in the above-mentioned example and connecting with the convex surface 30 via rounded portions 48 of small radius of curvature (about 1 mm in the above-mentioned example).

The number of radial grooves 38 lies in the range 6 to 20, the angle at the center a between the axes of two consecutive grooves lies in the range 60° to 18° .

The profile of the bottom 44 of each radial rib can be defined (FIG. 2) by a convex circular arc of radius R6 that connects tangentially with the plane annular surface 28 via a concave circular arc of radius R7, and that connects with the cylindrical surface 36 via a concave circular arc of radius R8 and a convex circular arc of radius R9, the circular arc of radius R9 connecting tangentially with the circular arc of radius R1 of the surface 36 and with the circular arc of radius R8, the circular arc of radius R8 itself connecting tangentially with the circular arc of radius R6.

The bottom 44 of each radial rib connects tangentially with the plane annular surface 28 of the bottom of the bottle and with the concave annular connecting surface 34 between said plane annular surface 28 and the convex surface 30 for standing on a support 32.

It is because the bottoms of the grooves 38 connect tangentially with the plane annular surface 28 that it is possible to prevent upwardly and downwardly directed deformation of the bottom under the effect of pressure variations inside a sealed full bottle, and that the plane portion 28 of the bottom can be kept at a substantially constant distance d from the bearing surface 32 of the bottle (pressure variations due to shrinkage of the material or to temperature variations being less than 0.5 bar for a bottle containing still water), said distance remaining substantially the same regardless of whether the bottle is full or empty.

In the above-mentioned numerical example, the radius R6 may be about 5 mm, the radius R7 about 45 mm, the radius R8 about 5.5 mm and the radius R9 about 1.5 mm.

The concave central portion 26 of the bottom of the bottle has a diameter substantially smaller than that of the top 14 of the bottle (e.g. about 18 mm to 20 mm when the top has a diameter of about 30 mm) and connects with the plane annular surface 28 which has a radial width or extent that is advantageously greater than the radius of the concave central portion 26 of the bottom.

The resistance of the bottom of the bottle to puncturing stresses in the case of a stacked and palletized load is greatly increased. As a result, the stability of the stacked and palletized load is improved.

The holding strength of the bottle in storage is also improved, with no listing deformation (tilting relative to the vertical) being noted after storage for seven days at 40° C.

Furthermore, no rupture of the bottom has been observed in vertical drop tests from a height of one meter (bottles being made of PET filled with still water and hermetically sealed).

Figure 4:
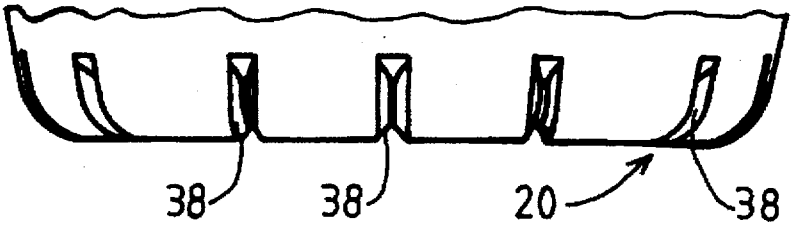
FIGS. 4 and 5 are diagrammatic elevation and bottom views of a bottle of substantially rectangular section.
Figure 5:
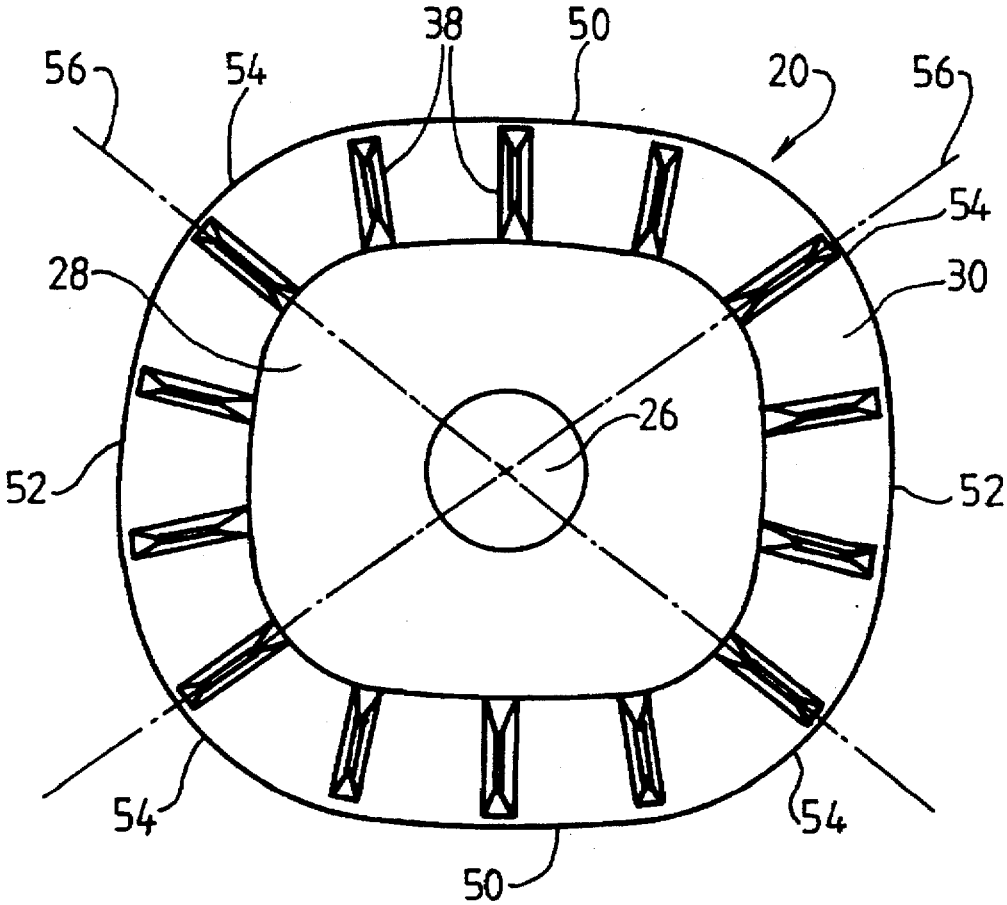

In the embodiment of FIGS. 4 and 5, the bottle has a substantially rectangular cross-section having convex curved sides, and its bottom 20 has a curved outline that is substantially rectangular, being defined by two long convex sides 50 and two short convex sides 52, inter-connected by convex circular arcs or rounded portions 54.

As above, the bottom 20 comprises an indented concave central portion 26, that connects via a plane annular surface 28 with a convex peripheral surface 30 for standing on a support surface, and regularly spaced-apart radial ribs 38 formed in said convex surface 30.

As can be seen clearly in FIG. 5, radial grooves 38 are formed along the diagonals 56 of the bottom 20. The number of grooves advantageously lies in the range 12 to 16 (it is 14 in the example shown), and can lie in the range 8 to 20 or 10 to 20 as a function of the shape and size of the bottom.

Figure 3:
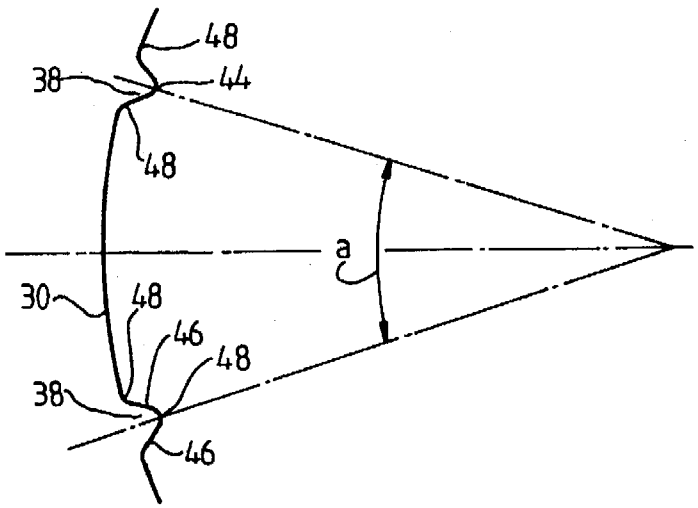
FIG. 3 is a fragmentary view in cross-section on line III—III of FIG. 2.
Figure 2:
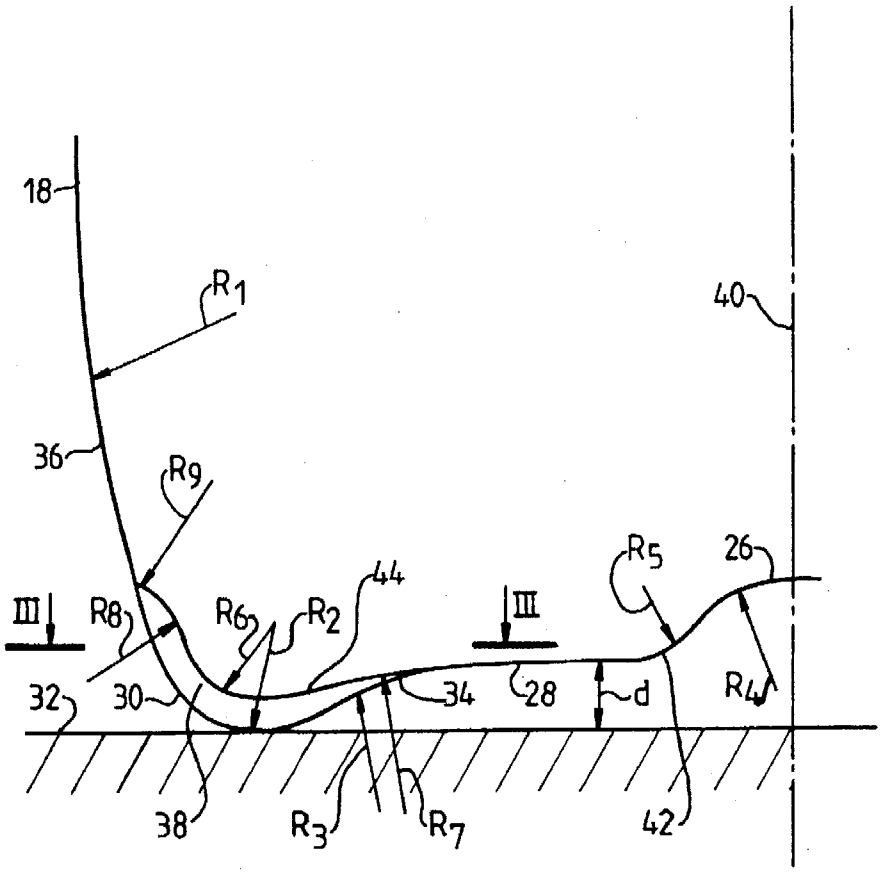
FIG. 2 is a larger-scale diagrammatic half-view in axial section of the bottom of said bottle.

Otherwise, the characteristics of the bottom of the bottle of FIGS. 4 and 5 are the same as those already described for the bottle of FIGS. 1 to 3.

Figure 6:
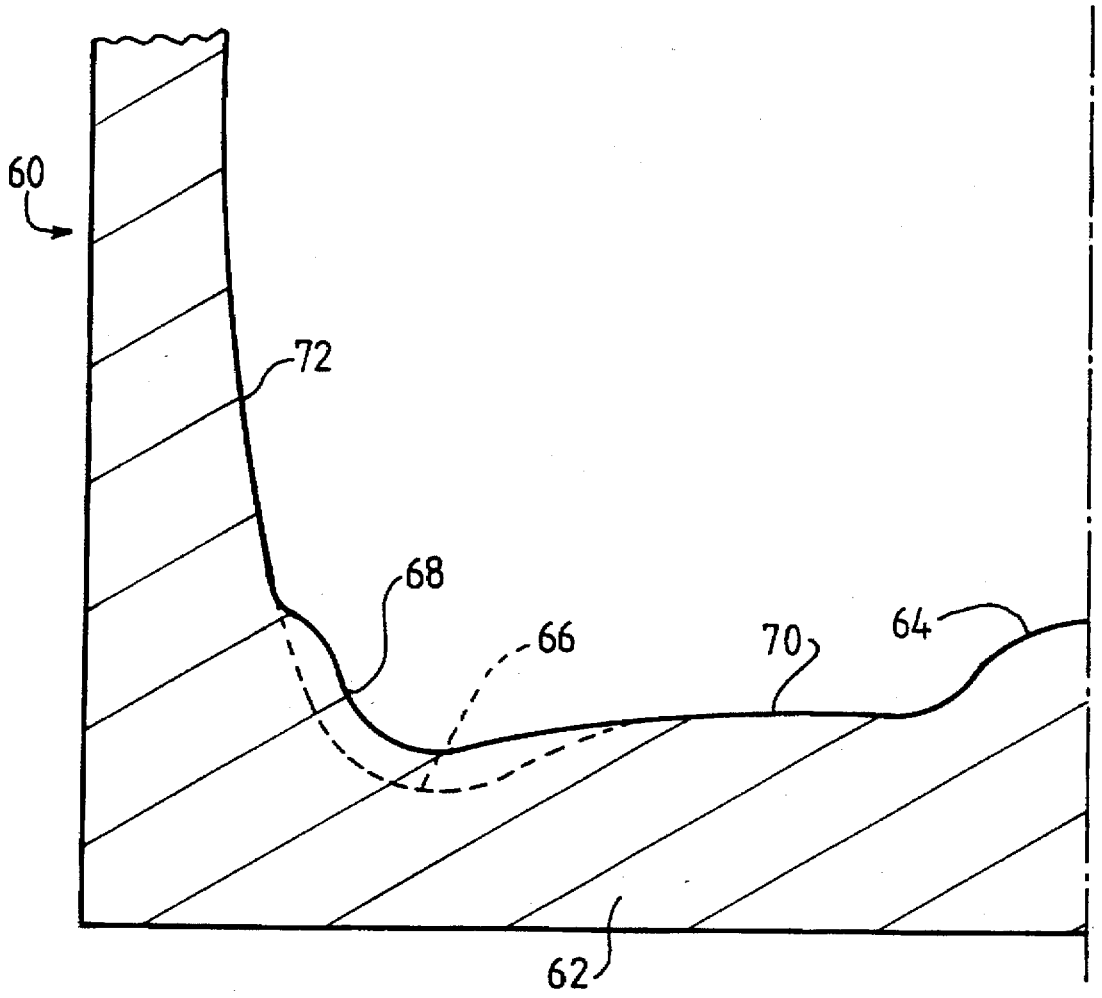
FIG. 6 is a diagrammatic fragmentary view in axial section of a mold for making a bottle of the invention.

FIG. 6 is a diagrammatic fragmentary view in axial section of a mold for making a bottle of the invention, such as the bottle of FIGS. 1 to 3.

The mold 60 comprises a bottom wall 62 having an inside face comprising a convex-shaped projecting central surface 64, a concave peripheral surface 66 including regularly spaced-apart radial ribs 68, and a substantially plane annular surface 70 which connects the convex central surface 64 with the concave peripheral surface 66, the concave peripheral surface 66 connecting with the inside peripheral face 72 of the mold.

The shapes of the inside face of the bottom of the mold corresponds to the shapes of the bottom of the bottle of FIGS. 1 to 3 with inverted curvature, the concave surfaces of the bottom of the mold corresponding to the convex surfaces of the bottom of the bottle, and vice versa, and the radial ribs 68 of the bottom of the mold corresponding to the radial grooves 38 of the bottom of the bottle.

We claim:

1. A molded plastics bottle, comprising a neck designed to receive a top, a substantially cylindrical side wall, and a bottom formed with a concave portion and a convex peripheral surface which includes radial grooves and which connects with the concave central portion of the bottom via a substantially plane annular surface, the bottle being characterized in that the bottom of each radial groove connects substantially tangentially with said plane annular surface.

2. A bottle according to claim 1, wherein the radial width of said plane annular surface is greater than the radius of the concave portion of the bottom.

3. A bottle according to claim 1 wherein the diameter of the concave central portion of the bottom is smaller than the diameter of the top for screwing onto the neck of the bottle.

4. A bottle according to claim 1, wherein the convex peripheral surface of the bottom connects with the plane annular surface via a concave annular surface.

5. A bottle according to claim 1, wherein the convex peripheral surface of the bottom connects with the side wall via a convex cylindrical surface whose generator line is a circular arc having a large radius of curvature.

6. A bottle according to claim 4, wherein the bottom of each radial groove formed in the convex peripheral surface connects tangentially with the concave annular surface.

7. A bottle according to claim 1, wherein the bottom of each radial groove connects with the side wall of the bottle via a convex surface followed by a concave surface.

8. A bottle according to claim 1, wherein the radial grooves have a V-shaped cross-section.

9. A bottle according to claim 1, wherein the profile of the bottom of each radial groove comprises a convex circular arc connecting via a concave circular arc with the plane annular surface of the bottom of the bottle and via a convex circular arc followed by a concave circular arc with the side wall of the bottle.

10. A bottle according to claim 1, wherein its bottom has a circular outline and the number of radial grooves lies in the range 6 to 20.

11. A bottle according to claim 1, wherein its bottom has a substantially polygonal outline, and comprises evenly spaced radial grooves.

12. A bottle according to claim 11, wherein the radial grooves extend along the diagonals of the bottom.

13. A bottle according to claim 11, wherein the number of radial grooves lies in the range 8 to 20.

14. A bottle according to claim 1, wherein, when it is full, said plane annular surface remains at substantially the same axial distance (d) from the bottom of the convex peripheral surface as when the bottle is empty.

15. A mold for making a bottle of plastic material, the mold comprising a bottom wall formed with a convex surface, a concave peripheral surface including radial ribs and a plane annular surface connecting the central surface to the concave peripheral surface, the mold being characterized in that the top of the radial ribs connect substantially tangentially with said plane annular surface.

* * * * *

UNITED STATES PATENT AND TRADEMARK OFFICE

CERTIFICATE OF CORRECTION

PATENT NO. : 5,713,480

DATED : February 3, 1998

INVENTOR(S) : Jean-Marie Petre et al.

It is certified that error appears in the above-identified patent and that said Letters Patent is hereby corrected as shown below:

Column 6, line 25, "the" (first occurrence) should be deleted.

Signed and Sealed this

Twenty-first Day of April, 1998

Bruce Lehman

*Attest:*

BRUCE LEHMAN

*Attesting Officer*

*Commissioner of Patents and Trademarks*